United States Patent [19]

Reinelt et al.

[11] Patent Number: 4,532,851

[45] Date of Patent: Aug. 6, 1985

[54] LIQUID-PROPELLANT SYSTEM

[75] Inventors: Karlheinz Reinelt, Hermannsburg; Wolfram Witt, Düsseldorf, both of Fed. Rep. of Germany

[73] Assignee: Rheinmetall GmbH, Düsseldorf, Fed. Rep. of Germany

[21] Appl. No.: 31,112

[22] Filed: Apr. 13, 1979

[30] Foreign Application Priority Data

Apr. 21, 1978 [DE] Fed. Rep. of Germany ..... 2817507

[51] Int. Cl.[3] ..... F41F 1/00; C06D 5/00

[52] U.S. Cl. ..... 89/7; 149/2

[58] Field of Search ..... 89/7, 1.815; 102/38 LP, 102/100, 101, 102, 104, 283, 285, 286, 292; 149/2 R

[56] References Cited

U.S. PATENT DOCUMENTS

| | | | |
|---|---|---|---|
| 2,995,987 | 8/1961 | Fitzpatrick | 89/7 |
| 3,379,097 | 4/1968 | Fisher | 89/1.815 |
| 3,691,769 | 9/1972 | Keilbach et al. | 149/2 |

*Primary Examiner*—Stephen C. Bentley

*Attorney, Agent, or Firm*—Karl F. Ross; Herbert Dubno

[57] ABSTRACT

A nonhypergolic propellant for a barrel-type weapon is mixed with about 20% by volume of a propellant granulate which can be in the form of spheroidal powder, preferably a dibasic powder propellant, or in the form of micro-encapsulated liquid propellant which can be of the same composition as the liquid propellant in which the granulate is entrained or can be a different liquid propellant. The propellant granulate improves the combustion characteristics of the propellant and hence the reproducibility of the firing operations.

10 Claims, 1 Drawing Figure

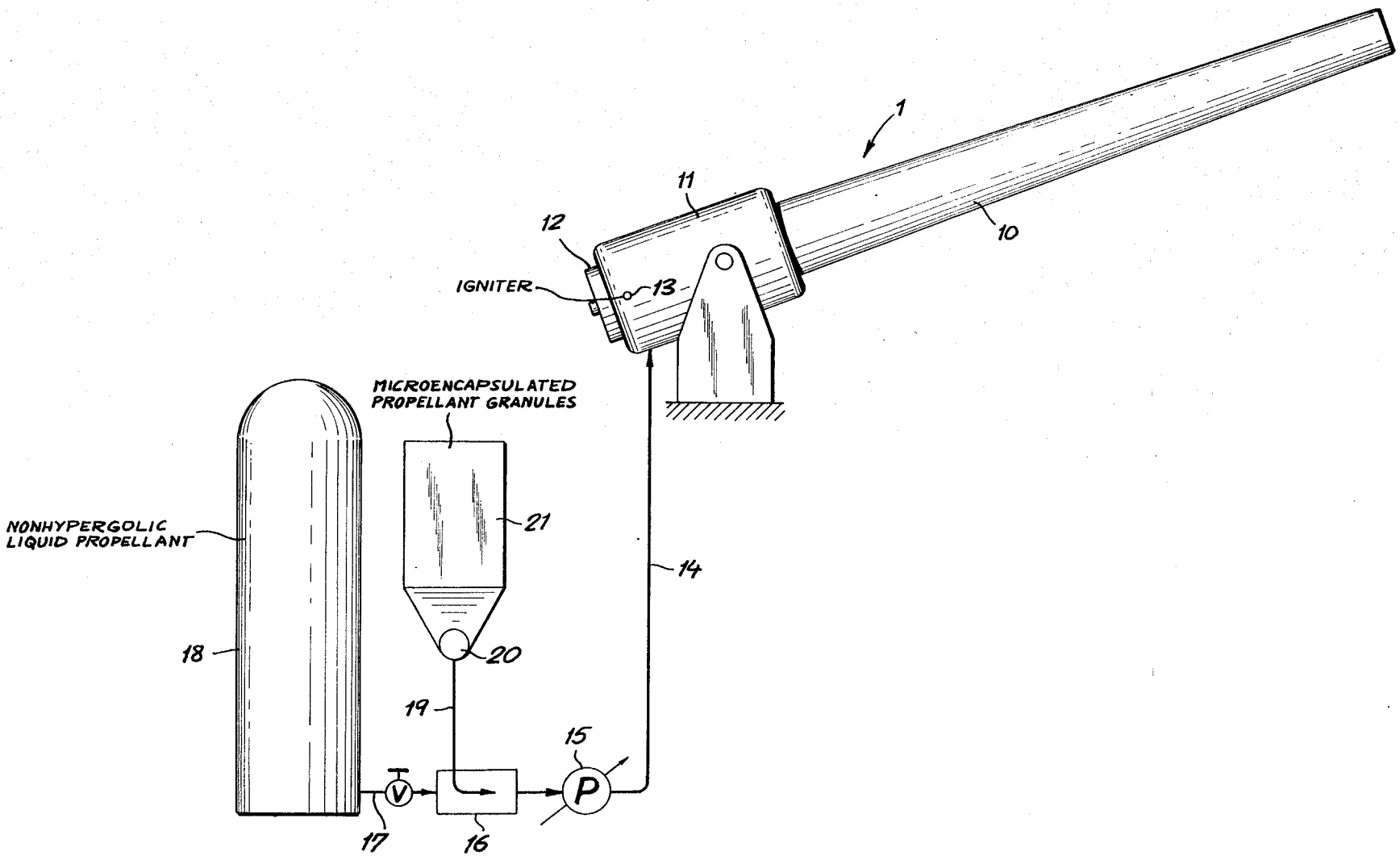
1
10
11
12
13
IGNITER
14
15
P
16
17
V
18
NONHYPERGOLIC LIQUID PROPELLANT
19
20
21
MICROENCAPSULATED PROPELLANT GRANULES

LIQUID-PROPELLANT SYSTEM

CROSS-REFERENCE TO RELATED APPLICATION

The present application is related to the commonly assigned copending application Ser. No. 549,382 filed Feb. 10, 1975 and entitled—METHOD OF AND ASSEMBLY FOR FIRING PROJECTILES WITH CONTROLLED GASIFICATION OF A LIQUID PROPELLANT.

FIELD OF THE INVENTION

The present invention relates to improvements in the firing of projectiles with liquid propellants and, more particularly, the firing of barrel-type weapons with liquid nonhypergolic propellants.

BACKGROUND OF THE INVENTION

As will be apparent from the aforementioned copending application, the use of liquid propellant for barrel-type weapons, i.e. to propel projectiles from the barrels of such weapons, is of significance in many cases in which cartridge-type munitions are unnecessary or disadvantageous.

This is because the liquid propellant can be stored in a convenient way in tanks in the region of the weapon and can be fed also in a simple manner to the combustion chamber of the weapon, e.g. by a metering pump or the like.

Liquid propellants have the advantage that, by controlling the composition of the propellant and/or the quantity thereof fed to the weapon, the muzzle velocity of the projectile can be adjusted at will and hence its firing range can be varied in a particularly simple or convenient manner.

It is known to provide liquid propellants such as hydrazine, isopropyl nitrate, nitromethane and the like for firing barrel weapons with liquid propellants.

In general, the liquid propellants may be so-called monopropellants in which the fuel is premixed with an oxidizer and is ignited by an igniter at the firing chamber of the weapon, or bipropellants in which the oxidizer is combined with the fuel at the chamber. In both cases, for the purposes of the present invention, the fuel or propellant should be nonhypergolic, i.e. not spontaneously ignitable by contact of the oxidizer with the fuel.

Work with liquid propellants such as hydrazine, isopropyl nitrate, nitromethane and the like has shown that the firing pattern is not always reproducible.

The problem appears to arise, with conventional liquid-propellant-fired barrel weapons, from two mechanisms which come into play and interact upon ignition.

The first is the significant dependency of the ignition and propagation of the ignition upon the configuration, extent and nature of the propellant surface. This surface varies during the ignition and combustion operations.

The second significant effect is that of the shock waves which are invariably generated upon ignition and which travel through the liquid propellant and repeatedly are reflected from the combustion chamber walls. As a result of these shock waves, high-pressure peaks can be observed.

Since gas bubbles almost invariably are present in the liquid propellant, these shock waves bring about compression followed by expansion of the bubbles and premature ignition at selected locations with increase in the magnitude and number of these shock waves.

To avoid these disadvantages it has been proposed to provide clusters of passages or elements within the vaporization and/or combustion chamber so as to improve the uniformity of the gasification process (see the aforementioned copending application). Other techniques which have been proposed include the mixing of surface-active agents with the liquid propellant so as to foam the latter and provide an extremely large surface area at which gasification or combustion can occur.

While both of these techniques have been found to be effective to some degree and may be used in conjunction with the present invention, they have by themselves been found to have certain disadvantages. For example, the first technique requires modification of the structure of the weapon to a significant degree. This is not desirable where improvements in the firing of existing weapons without structural modification thereof are desired. The second technique provides an inordinately large volume for the propellant which also may require enlargement or modification of the firing chamber.

OBJECTS OF THE INVENTION

It is the principal object of the present invention, therefore, to improve upon the liquid-propellant firing of barrel-type weapons whereby the disadvantages of the earlier systems can be avoided and which does not require significant modification of the weapon.

It is another object of the invention to provide a method of and an apparatus for the firing of barrel-type weapons with nonhypergolic liquid propellants which maintains the advantages of the liquid-propellant firing systems mentioned above but nevertheless affords a reproducible firing pattern and selectable muzzle velocities.

It is also an object of the invention to provide a method of and a system for the firing of barrel-type weapons in which the liquid propellant will retain its good pumping characteristics and hence the ability to be metered effectively to the weapon while nevertheless affording reproducible firing techniques.

SUMMARY OF THE INVENTION

These objects and others which will become apparent hereinafter are attained, in accordance with the present invention, with a system in which the barrel-type weapon is fed with a propellant mixture containing a liquid nonhypergolic propellant and a granulated propellant additive. Thus an additive of a propellant granulate or particles is provided for the liquid nonhypergolic propellant which is fed to the weapon and ignited in the combustion or gasification chamber thereof.

According to one feature of the invention, the additive is in the form of spheroidal powder, i.e. powder whose particles have generally ball shapes, with the preferred spheroidal powder being a dibasic propellant powder.

Alternatively, the propellant granulate is in the form of microcapsules, i.e. is micro-encapsulated liquid propellant which may be of the same composition as the liquid propellant entraining the granulate into the weapon or another liquid propellant.

Best results have been found with an additive of about 20% by volume of the propellant granulate in the liquid-propellant heterogeneous system fed to the weapon. The particle size of the granulate should be such as not to impede the pumping characteristics of the liquid propellant and thus can be between 1 micron and 200 microns, depending upon the granulate used.

The particles which may be mixed with the liquid propellants, which can be those mentioned above or any described in the aforementioned copending application, can be those discussed at pages 16 ff. of "Elements of Ammunition", Major Theodor C. Ohart, John Wiley & Sons, London, 5th printing, 1956, while the dibasic propellant powder can be of the type described at page 27 of this work.

The liquid propellants used in the microcapsules can be any of those previously mentioned and the micro-encapsulation of these liquid propellants can be effected as described in U.S. Pat. Nos. 2,299,694, 2,712,507, 3,016,308, 3,429,827 and 3,720,534.

The surprising result of the addition of the propellant granulate to the liquid propellant is that, without modifying the ability to meter the resulting heterogeneous mixture into the combustion or gasification chamber of the barrel-type weapon, the gas pressure development pattern is found to have a quiescent characteristic, free from pressure peaks and the development of shock waves.

The nonreproducible firing characteristics of the liquid propellant alone are completely excluded and this is believed due to the elimination of irregular firing patterns within the liquid propellant.

When about 20% of the propellant granulate is added to the liquid propellant, the gas pressure curve is found to be smooth.

The additive proportion may be varied within the range of 10–30% although at the upper end of this range problems may be encountered in pumping the mixture to the weapon while, at the lower end of the range, an incipient irregularity can be noticed in the gas pressure curve.

BRIEF DESCRIPTION OF THE DRAWING

The above and other objects, features and advantages of the present invention will become more readily apparent from the following description, reference being made to the sole FIGURE of the accompanying drawing which represents a weapon system for the purposes of the present invention.

SPECIFIC DESCRIPTION

In the drawing, we have shown a barrel-type weapon 1 which comprises the barrel 10 from which the projectile is to be propelled, with a firing chamber 11 at the lower end of the barrel and a breech 12 through which the projectile can be inserted into the barrel above the firing chamber. The firing chamber is provided with an igniter 13 which can be of the type described in the aforementioned copending application.

A tank 18 of nonhypergolic liquid propellant is connected to the firing chamber 11 by a metering pump 15 and ducts 17 and 14, ahead of the doser 15, there being provided a mixing chamber 16 into which propellant granules can be fed.

The propellant granules can be received in a hopper 21 and metered by any conventional solids metering device 20 via duct 19 into the mixing chamber 16. The heterogeneous mixture of nonhypergolic liquid propellant and the propellant granules is then fed to the weapon and fired in the usual manner.

By way of example, a conventional liquid-propellant mixture of hydrazine and nitrogen tetroxide is mixed with 20% by volume of the dibasic powder described at page 27 of "Elements of Ammunition" or 20% by volume of the same fuel mixture micro-encapsulated in the manner described above. In both cases, the firing of the weapon is effected without any of the problems of irregular pressure development characterizing the use of the liquid propellant alone.

The system has been found to provide reproducible control of the firing characteristics of the weapon within a wide range of muzzle velocities, etc., so that it can be used for the firing of pistols, rifles, heavy automatic rifles, automatic cannon or large-caliber cannon.

We claim:

1. A method of operating a barrel-type weapon comprising the steps of:

feeding to a gasification chamber of said weapon a nonhypergolic liquid propellant and gasifying said propellant in said chamber to drive a projectile from the barrel of said weapon; and adding to said liquid propellant a dibasic propellant in the form of a spheroidal powder prior to introduction of the liquid propellant into said chamber.

2. A method of operating a barrel-type weapon comprising the steps of:

feeding to a gasification chamber of said weapon a nonhypergolic liquid propellant and gasifying said propellant in said chamber to drive a projectile from the barrel of said weapon; and adding to said liquid propellant a propellant granulate prior to introduction of the liquid propellant into said chamber, said propellant granulate being in the form of micro-encapsulated liquid propellant.

3. The method defined in claim 2 wherein the micro-encapsulated liquid propellant is the same propellant as is introduced into said chamber in admixture with the granulate.

4. The method defined in claim 2 wherein the micro-encapsulated liquid propellant is different from the liquid propellant introduced into the chamber in admixture with the granulate.

5. The method defined in claim 1 or 2 wherein the granulate is added in an amount of about 20% to the liquid propellant.

6. A propellant for a barrel-type weapon which comprises a liquid nonhypergolic propellant admixed with a propellant granulate in the form of a dibasic propellant powder of spheroidal particles.

7. A propellant for a barrel-type weapon which comprises a liquid nonhypergolic propellant admixed with a propellant granulate in the form of micro-encapsulated liquid propellant.

8. The propellant defined in claim 7 wherein the micro-encapsulated liquid propellant is the same liquid propellant as the granulate is mixed with.

9. The propellant defined in claim 7 wherein the micro-encapsulated liquid propellant is different from the liquid propellant with which the granulate is mixed.

10. The propellant defined in claim 6 or 7 wherein 20% consists of the propellant granulate.

* * * * *